United States Patent [19]

Damico et al.

[11] 4,104,710

[45] Aug. 1, 1978

[54] PATIENT HEADWALL UNIT

[75] Inventors: Frank M. Damico, Stevens Point; Patrick John O'Toole, Wisconsin Rapids, both of Wis.

[73] Assignee: Joerns Furniture Company, Division of American Seating Company, Stevens Point, Wis.

[21] Appl. No.: 801,735

[22] Filed: May 31, 1977

[51] Int. Cl.[2] ..... A47B 97/00

[52] U.S. Cl. ..... 362/130; 362/127; 362/147; 362/234; 362/295; 362/801

[58] Field of Search ..... 240/2 W; 362/127, 130, 362/147, 234, 295, 801

[56] References Cited

U.S. PATENT DOCUMENTS 3,803,396 4/1974 Damico ..... 240/2 W

*Primary Examiner*—Stephen J. Lechert, Jr.

*Attorney, Agent, or Firm*—Price, Heneveld, Huizenga & Cooper

[57] ABSTRACT

A patient room headwall unit consisting of an integral module for suspension on the headwall of a hospital room between two patient beds. The unit, which is prewired during assembly at the factory, includes a center section having provisions for gas, communication or nurse call and electrical services, the same being accessible at either bed through use of pendant controls and the like. It also includes a lighting section at either side of the central section for providing reading light and both high and low intensity general room illumination at each patient bed. The unit, ordinarily, will be installed in conjuction with ceiling-drop services and a telescopic shroud is provided to conceal these services once installation has been completed.

41 Claims, 24 Drawing Figures

PATIENT HEADWALL UNIT

BACKGROUND OF THE INVENTION

This invention relates to a patient room headwall unit and, more specifically, a headwall unit adapted to be hung on the headwall of a patient room between two beds and to provide the necessary lighting, communication, gas and other electrical services to both beds.

It has been proposed heretofore in the art to provide patient service modules hangable from the headwall of a patient room capable of at least partially supplying the necessary services such as gas, electricity, nurse call systems and lighting to the hospitalized patients. These units have achieved primary effectiveness, particularly insofar as lighting is concerned, when a single module was utilized for a single bed as shown, for example, in U.S. Pat. No. 3,769,502, issued Oct. 30, 1973, to Schultz, et al, and U.S. Pat. No. 3,803,396, issued Apr. 9, 1974, to Frank M. Damico. The provision of two separate-wings for each bed, as is illustrated in these patents, was necessitated primarily by the desire to achieve satisfactory lighting conditions at the patient bed. The resultant configuration, however, is quite expensive on a per bed basis and many hospitals for which the differing modular concepts disclosed by these patents held a great deal of appeal simply could not afford them.

It has also been proposed to service a pair of beds by positioning a single module in between them. Examples of such proposals are shown in U.S. Pat. No. 3,084,247, issued Apr. 2, 1963, to Mitchell Bobrick; U.S. Pat. No. 3,200,244, issued Aug. 10, 1965, to R. K. Meyer; U.S. Pat. No. 3,461,349, issued Aug. 12, 1969, to R. K. Meyer; U.S. Pat. No. 3,462,892, issued Aug. 26, 1969, to R. K. Meyer; U.S. Pat. No. 3,557,359, issued Jan. 19, 1971, to R. K. Meyer; and, U.S. Pat. No. 3,567,842, issued Mar. 2, 1971, to R. K. Meyer. The units shown in these patents, while achieving limited success, have not effectively dealt with the lighting problem particularly insofar as reading light is concerned. This reading light problem is accentuated when one considers the fact that a patient in a particular environment will adjust the head section of his bed to varying angles throughout the course of the day or night. While this problem has been solved to some extent through use of lights suspended from adjustable arms, such as shown, for example, in U.S. Pat. No. 3,354,301, issued Nov. 21, 1967, to Bobrick, many patients are unable or unwilling to make the necessary adjustments and it has been necessary, typically, to provide supplemental ceiling reading light as illustrated in this patent, frustrating to great extent the entire modular approach and the heretofore at least theoretical economies to be gained through its use.

SUMMARY OF THE INVENTION

The present invention provides an integral patient headwall unit adapted to be hung from the patient headwall between adjacent beds. The unit includes a generally rectangular vertically elongated central section having means therein for accommodating electrical services and means for making such services available at the exterior of the unit for use at either of the beds. A vertically elongated lighting section is fabricated integrally with and affixed to either side of the central section, each of the lighting sections being of a heighth generally equal to the central section. Each lighting section includes a reading light, a general room illumination light and means for directing the light rays from a reading light downwardly, outwardly and forwardly onto the upper section of the bed positioned thereby. Means are provided for switching the reading and general room illumination lights, both on the unit itself and by remote control.

DETAILED DESCRIPTION OF THE PREFERRED EMBODIMENT

Figure 3:
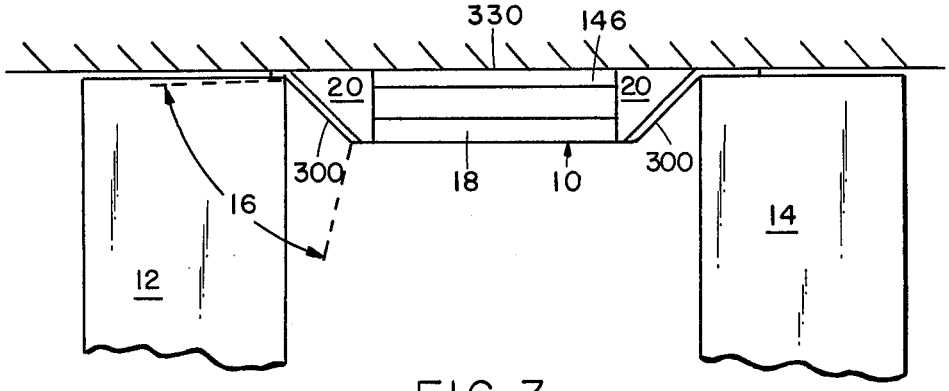
FIG. 3 is a schematic, plan view of the system with the expandable shroud removed illustrating the manner in which the unit is adapted to have a patient bed positioned at either side thereof.
Figure 20:
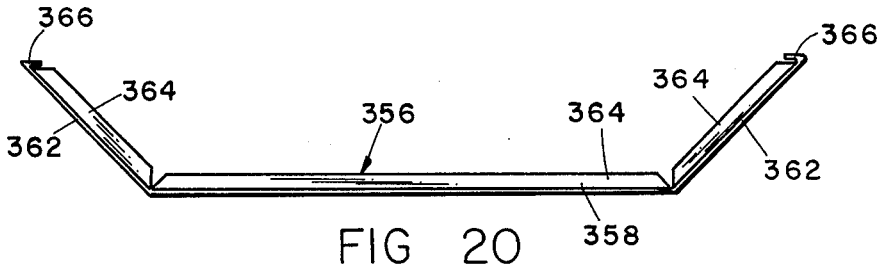
FIGS. 20 and 21 are plan and front elevation views, respectively, of the lower or exterior shroud component.
Figure 21:
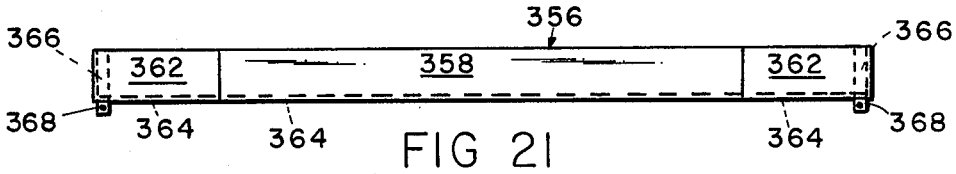
Figure 18:
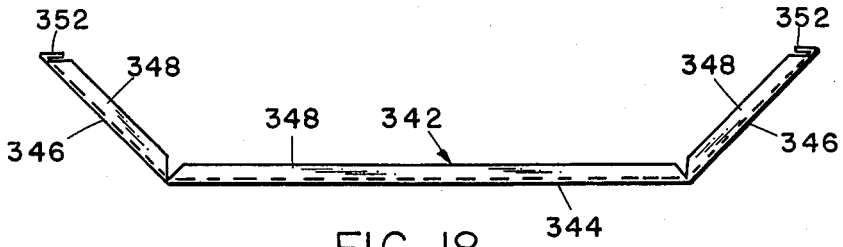
FIGS. 18 and 19 are plan and front elevation views, respectively, of the inside or upper shroud component.
Figure 19:
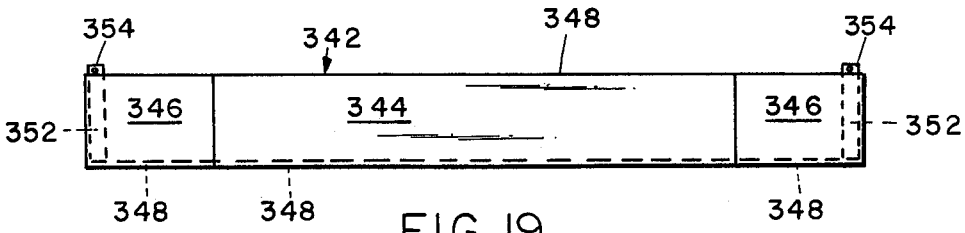

Referring initially to FIGS. 1–4, the patient headwall unit 10 is designed to be hung from or otherwise supported against the headwall 330 in a patient room elevated from the floor 331 to facilitate cleaning and the like. Beds 12 and 14 are positioned conventionally to either side of the headwall unit 10 as illustrated in FIG. 3. The headwall unit, as will be described in detail hereinafter, contains the services necessary for the day-to-day care and rehabilitation of the patients in beds 12 and 14. The headwall unit, particularly, is designed to emit a pattern of light of reading intensity when the same is called for approximating the configuration indicated by the numeral 16 in FIG. 3. Since the reading light is emitted from a location substantially above the bed, it will be apparent that the patient will be able to read comfortably regardless of the angular position of the bed head section.

The headwall unit includes a central rectangular section 18 which is vertically elongated and, to either side thereof, a lighting section 20. These sections form an integral unit once fastened together during the manufacturing process and are shipped to the job site for installation as such.

Figure 4:
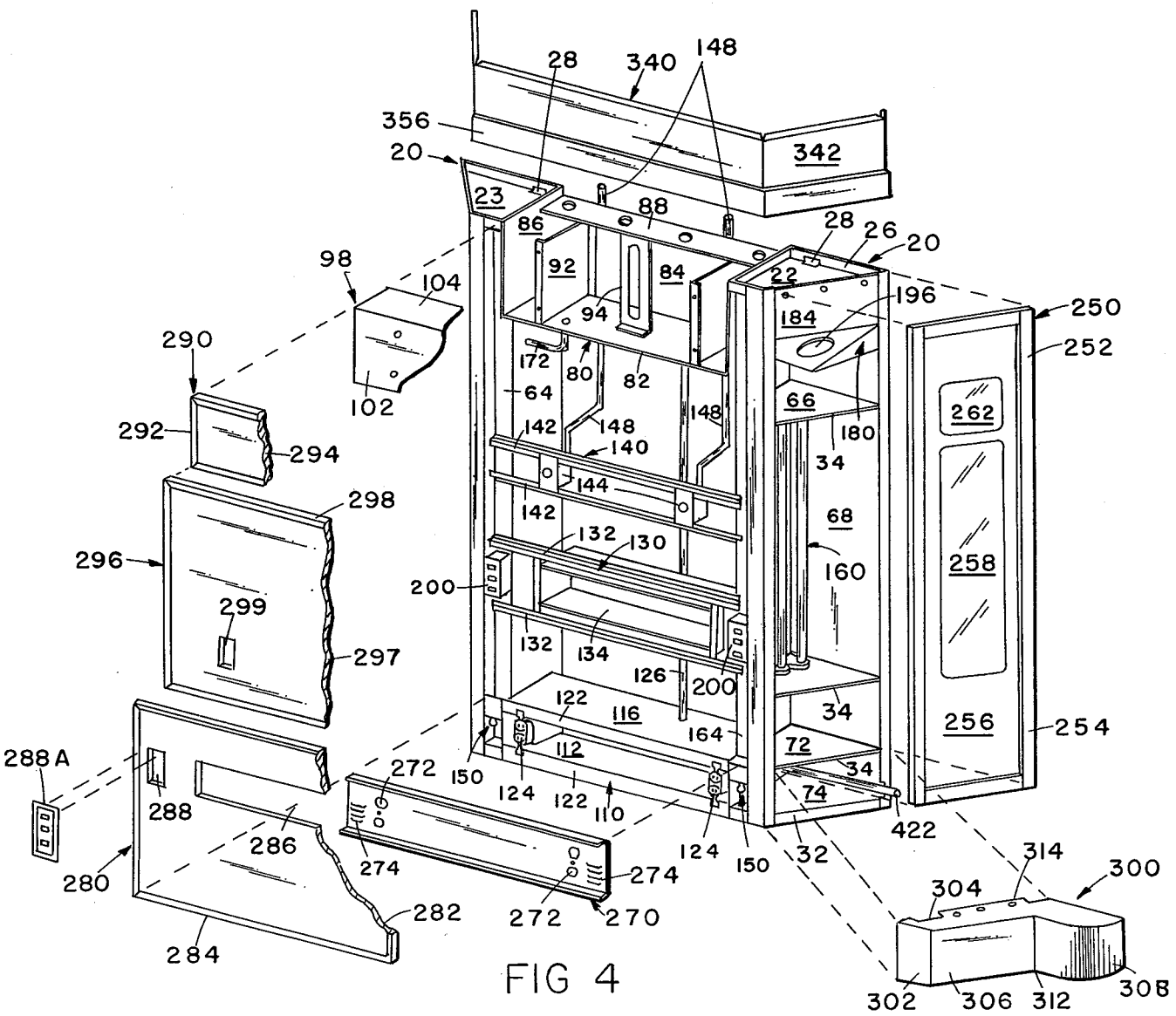
FIG. 4 is an exploded, perspective view of the system.
Figure 5:
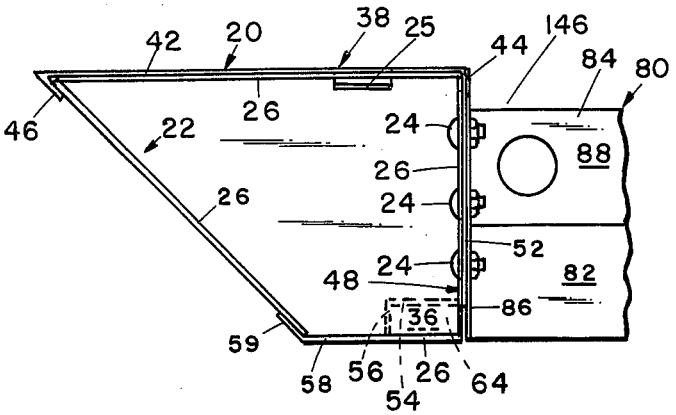
FIG. 5 is a fragmentary, plan view of one of the light sections and the interconnecting electrical box assembly.
Figure 6:
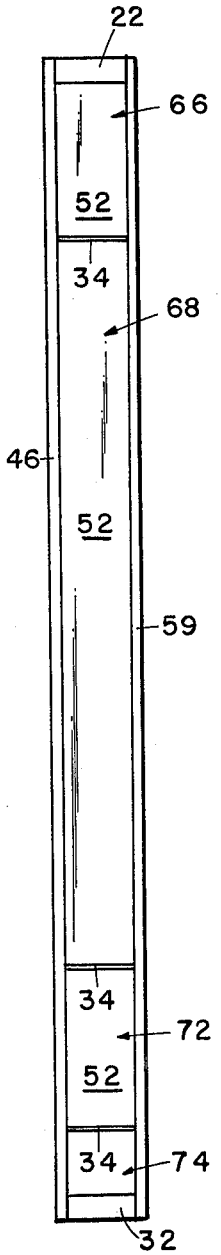
FIG. 6 is a side elevation of the light section.

The lighting sections 20 are mirror images of each other and only one will be described in detail. Referring, additionally, thus, to FIGS. 4–6, each of the sections comprises a top cap 22 which includes a generally planar member 24 having the shape of a frusto-right triangle with a lip or flange 26 turned upwardly at a right angle about substantially its entire periphery. The cap 22 and components adjacent thereto have a hanging aperture 28 formed through planar member 24, the rear upturned flange 26 and components adjacent thereto, the purpose of which will become clear hereinafter. The bottom cap 32 is mirror-image with respect to the top cap and will not be described in detail. It need not, of course, contain the hanging apertures but may do so to facilitate interchangeability of parts.

Positioned between the top and bottom caps, 22 and 32, respectively, are a series of intermediate members 34, the two higher of which function as reflectors in the manner to be described hereinafter. Members 34 include a rectangular cutout 36 and, conveniently, are formed with a bordering flange to facilitate affixation to the front and rear reflectors.

Rear reflector 38 runs lengthwise the entire distance between the top and bottom caps and includes a rear reflecting surface 42, having a right angled flange 44 along one side thereof and an acute angled flange 46 along the other side thereof. The front reflector 48, which is similar in length to rear reflector 38, includes a reflecting surface 52 and, proceeding counterclockwise as viewed in FIG. 5, a reach 54 which is perpendicular to surface 52, a reach 56 which is parallel to surface 52, a reach 58 which is perpendicular to surface 52 and, finally, an obtusely angled flange 59. Reaches 54 and 56 are foreshortened or notched sufficiently to permit assembly of the end caps and this reflector in the manner illustrated.

The lighting section components described thus far are preferably assembled in the form of a rigid weldment and, thereafter, the entire structure painted an off-white to provide the required reflecting surfaces to be discussed hereinafter. Alternatively, of course, only selected portions of the weldment could be painted, and, specifically, those within which the lights are to be located.

The resulting configuration forms an elongated accessory mounting channel 64 along the interior, forward portion of the lighting section. It is within and on this accessory channel that several of the components to be described hereinafter will be mounted. The weldment forms, additionally, a reading light housing 66, a general illumination light housing 68, a spare housing which could, if desirable, contain an observation light or some other type of service and a storage area 74, all of which will be discussed in detail hereinafter.

The electrical box assembly 80, which forms a component of central section 18, includes a base 82, backwall 84, sidewalls 86 and a partial topwall 88, suitable service knockouts 88 being provided on at least topwall 88 and sidewalls 86. Box 80 is divided into three separate compartments by divider plates 92 which also function to support and secure the cover 98. The box also contains a mounting strip 94 to facilitate component mounting.

Figure 13:
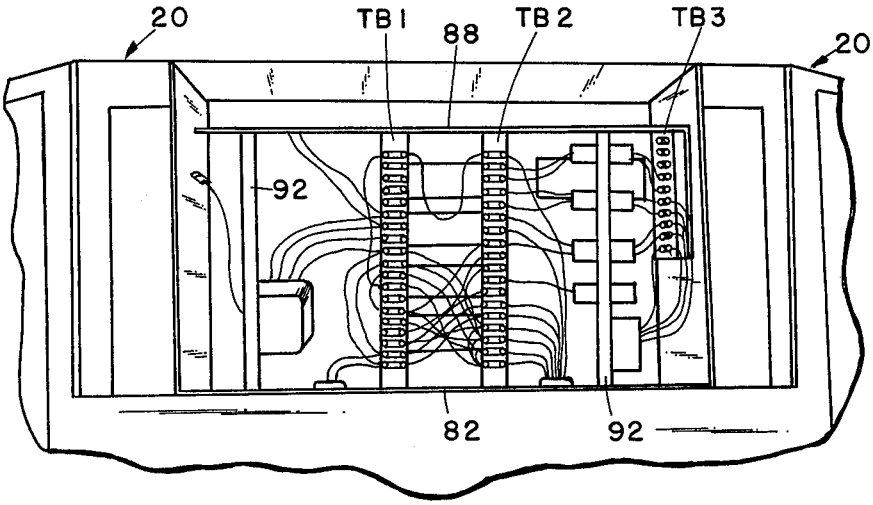
FIG. 13 is a fragmentary, perspective view of the electrical box after the various system components have been installed therein.

The central compartment between plates 92 is intended to receive the high or line voltage components. The left compartment (FIG. 4) will ordinarily contain a communications or nurse call terminal strip. The right compartment, as illustrated in FIG. 13, contains the low voltage light switching elements.

The box is provided at either side with upwardly extending flanges or sidewalls 86 which are suitably drilled to accept the bolts which interconnect electrical box 80 with the lighting sections 20. Box 80 includes, finally, a cover 98 including a top 104 and a front face 102 suitably apertured for machine screws or the like utilized to affix the cover to the front face of divider plates 92. Once affixed, of course, the electrical box 80 is completely sealed except for service entries and exits at the various knockouts.

The receptacle box assembly 110, which also forms a component of central section 18, includes a bottom wall 112, back wall 114, top wall 116, sidewalls 118 and converging but spaced frontal walls 122. Top wall 116 and sidewalls 118 are also provided with suitably positioned knockouts for the purposes hereinafter described.

The spacing of the converging frontal walls 122 of receptacle box 110 is such that outlets 124 may be affixed therein in the manner illustrated in FIG. 4 utilizing walls 122 to secure the outlets in position. A conduit interconnects receptacle box 110 with electrical box 80 through which power is supplied to the outlets 124, the night lights and, where utilized, the service extension option to be discussed hereinafter.

Receptacle box 110 may contain and, indeed, is designed to contain, more than the two outlets 124 illustrated. All that is necessary is to position the outlets across the front of the box at the positions desired providing suitable outlet-cover type apertures and cover plate 270 to be discussed hereinafter.

Figure 7:
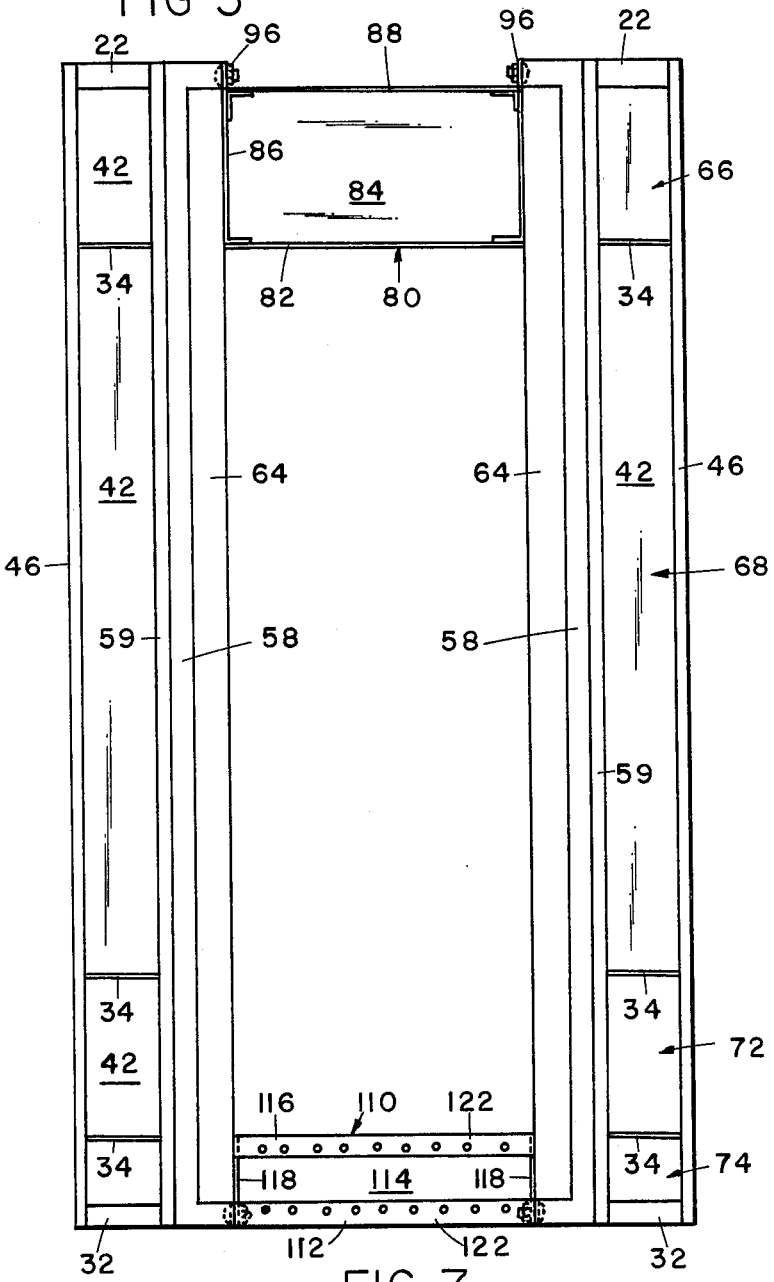
FIG. 7 is a front elevation view of the two light sections, the electrical box assembly and the receptacle box assembly illustrating the manner in which the same are interconnected to form a rigid structure.

The electrical box 80 and receptacle box 110 are utilized to affix the right and left light sections 20 into an integral assembly. The electrical box 80, more specifically, is bolted as shown specifically in FIGS. 5 and 7 through the flange 96, the front reflector 48 and the upturned flange 26 on top cap 22 to the upper extremities of lighting sections 20. The receptacle box assembly, similarly, is bolted at either end as indicated in FIG. 7 through the front reflector to the bottom cap 32. Once these connections are made, the framework for the central and lighting sections is established as a rigid unit.

Referring now specifically to FIG. 4, the nurse call or communications box assembly is indicated generally by the reference numeral 130. It comprises a pair of spaced support rails 132 suitably affixed to the flat surfaces of the accessory channels 64, spanning the distance therebetween. Supported from these rails by any conventional means is a metallic, rectangular box 134 having an open front. Box 134 should be sized so as to accept any of the numerous nurse call system chassis which are available on the market. The fascia plate and controls for the system, which will ordinarily be installed during fabrication of the unit, are indicated by the reference numeral 136 in FIG. 1. The nurse call system, of course, could be installed in the field but, due to sizing of the receiving aperture in the cover panel 280, to be discussed hereinafter, factory installation is preferred. The cable, in this situation, is tied off at a suitable terminal strip in the left-hand (FIG. 4) compartment of box 130. The field installer then makes his connections to this terminal strip.

Referring still to FIG. 4, the gas mount assembly, indicated generally by the reference numeral 140, also comprises a pair of support rails 142 suitably suspended between the accessory channels 64 across the front of central section 18. The rails are spaced so that the conventional hospital gas outlets 144 can be affixed therebetween in the manner illustrated. Again, as noted in conjunction with electrical box 110, more than the two illustrated gas outlets can be accommodated within the unit. The unit is preferably sized such, in fact, that a second pair of rails 142 can be positioned above those illustrated in FIG. 4 to accommodate additional outlets. It will not be atypical, for example, to have two rows of gas outlets, one above the other, each row consisting of as many as three different outlets including vacuum, oxygen and the like, depending upon the degree of usage anticipated in the particular patient beds associated with the unit.

A significant aspect of the present invention resides in the sizing of the depth of the electrical box 80 and, to lesser extent, the outlet box 110. The depth of the boxes is sized, more specifically, to provide a space 146 between the rear walls thereof and the patient headwall when the unit is installed. This permits the gas pipes 148 as well as the cable from the nurse call unit 136 which exits from box 134 through a conventional knockout, to be easily run upwardly through space 146 into the ceiling for connection to the respective gas supply and communications lines (when the nurse call is field-installed). These connections, as well as later modifications, can be accomplished facilely either during or at a long period subsequent to installation in the field.

Figure 8:
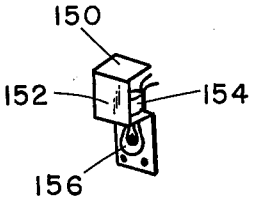
FIG. 8 is a perspective view of the night light assembly.

The night light assemblies 150, with continued reference to FIG. 4 and also, specifically, to FIG. 8, are positioned within the accessory channels 64 on either side of the receptacle box assembly 110. Each assembly 150 includes an S-shaped support bracket formed from metal having the lower bar of the "S" removed. The assembly is completed by a socket suitably affixed to bracket 154 and a low wattage bulb installed therein as indicated. The night lights, in the preferred embodiment of this invention, are "constant burn" and may be connected directly to the line voltage present within box 112 through suitable knockouts.

Figure 9:
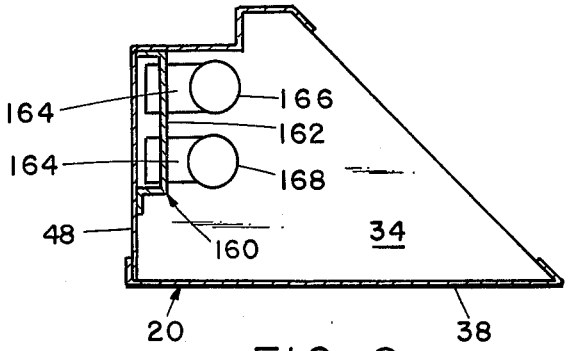
FIG. 9 is a cross section through the room light housing of one of the light sections.

Referring now additionally to FIG. 9, the room light or general illumination assembly, which is positioned within compartment 68 in each of light sections 20, includes a reflective painted (off-white) channel 162 having two socket-passage slots (not shown) at either end thereof. Channel 162 is affixed within compartment 62 and spans the distance between boundary members 34 thereof. Two fluorescent sockets in vertically aligned pairs are affixed to the facing surfaces of each of the members 34 bounding compartment 68. The sockets pass through the slots in channel 162. The low intensity bulb 166 is positioned immediately to the interior of accessory channels 64 in the approximate position illustrated in FIG. 9. This position, within the reach of section 54 of the front reflector, prevents undue glare outwardly and forwardly of the unit. Adjacent tube 166 is a second tube 168 which provides, in conjunction with tube 166, the high illumination and is run on line voltage as will be hereinafter described. The conductors from sockets 164 are run within channel 162 to the conduit 172 location and thence into the electrical box 80 wherein suitable connections, as hereinafter described, are made.

Figure 10:
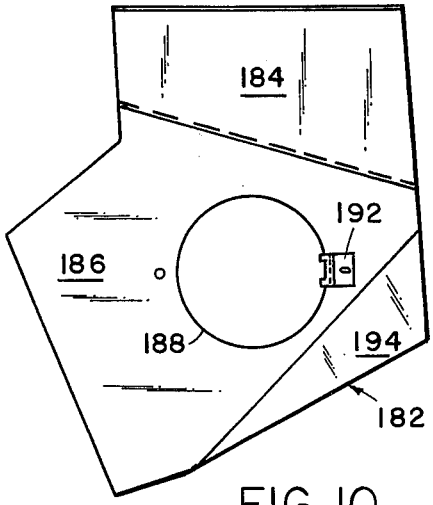
FIG. 10 is a plan view of the reading light reflector taken perpendicular to the bulb-containing surface.
Figure 11:
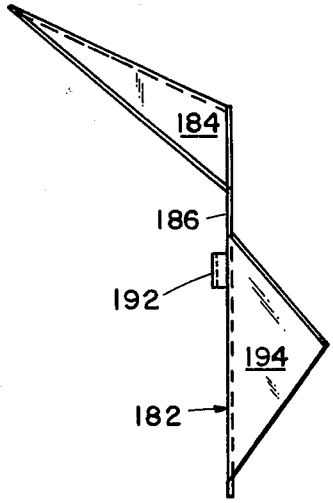
FIG. 11 is a side elevation of the reading light reflector as shown in FIG. 10.

Referring now specifically to FIGS. 4, 10 and 11, the reading light assembly 180 is positioned within compartment 66 of each of the lighting sections 20. Reading light assembly 180 includes a reflector 182 having a vertical section 184 which lies between and adjacent acute angle flange 46 of rear reflector 38 and obtuse angle flange 59 of front reflector 48. Section 184, preferably, is affixed to the exposed upturned flange of top cap 22 in the manner illustrated in FIG. 4.

The formed metal reflector 182 extends from the plane defined by surface 184 rearwardly and downwardly in the manner shown to form light containing section 186 and wing 194. Light containing section 186 is positioned perpendicularly to a line directed downwardly, outwardly and forwardly from the lighting section toward the upper section of the bed positioned thereby. It includes a circular aperture 188 which is very slightly smaller in diameter than the head of the sealed beam, low voltage bulb 196. The bulb 196 is retained in position by means of a first clip 192 brazed to the rear reflector surface and a second clip (not shown), identical to clip 192, which is secured to the rear side of the housing by means of screw or the like after placement of the bulb. The bulb is installed by removing reflector 182, placing it on the rear side thereof in the manner shown in FIG. 4 beneath clip 192, and securing the second clip.

Power is supplied to the bulb by means of a headlight-type socket, the harness for which passes directly into electrical box 80 from compartment 66 through a suitable passageway. The reading light 196, the low intensity room illumination bulb 166 and the high intensity room illumination bulb 168 are switched individually at switch 200, one such switch being positioned within the accessory channel 64 at either side of the unit. The switch 200 on a given side of the unit, of course, controls the lights on that side and that side only. Switches 200 are intended, primarily, for use by hospital staff personnel rather than the patients. Patient switching is accomplished through low voltage controls positioned within the pillow speaker, electronic bedside cabinet or the like.

Figure 12A:
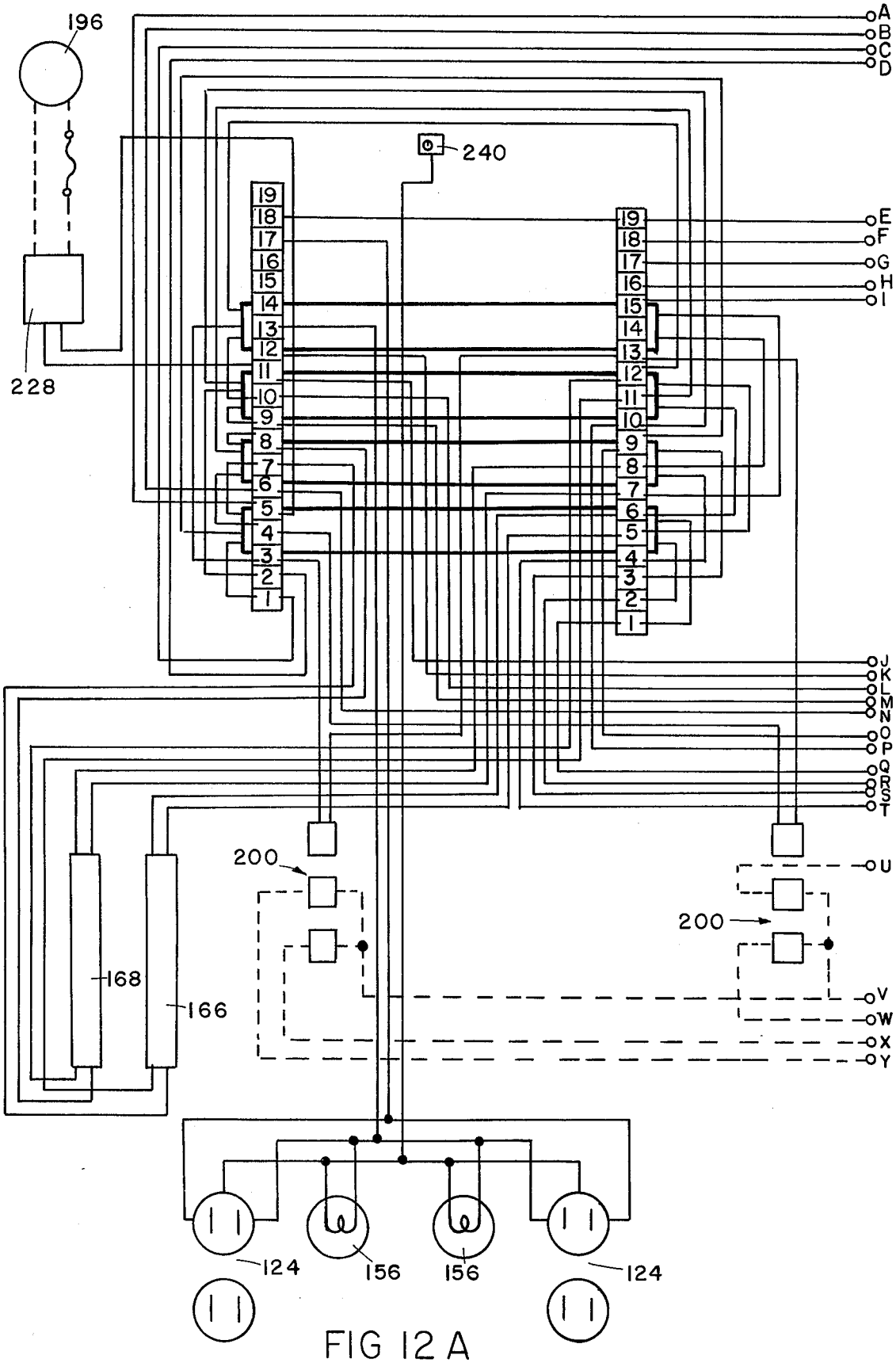
FIGS. 12*a* and 12*b*, fitted together as indicated, are the electrical schematic for the system.
Figure 12B:
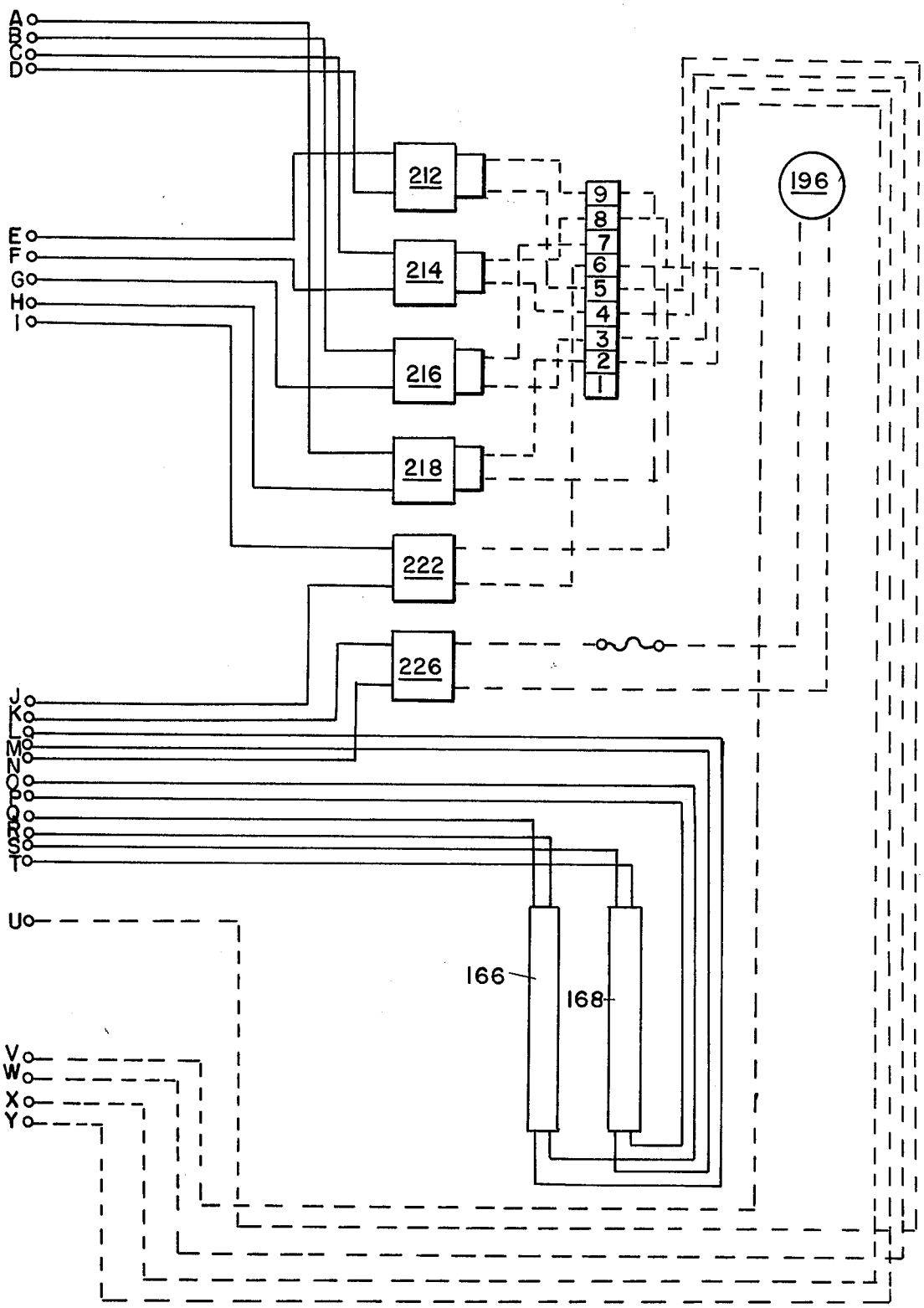

FIGS. 12*a* and 12*b* are the schematic for the preferred embodiment of the patient headwall unit 10. Line voltage carrying wire is generally indicated by solid lines and low voltage by dashed lines. All line voltage wiring is contained within electrical box 80 or enclosed in conduit as described.

The system, in addition to those components already discussed, includes first and second terminal blocks, TB1 and TB2, respectively, and a third low-voltage terminal block TB3. The terminal blocks, as illustrated in FIG. 13, are positioned within electrical box 180 in the general manner shown.

Also positioned within electrical box 80 during manufacture of the unit are the right room light relay 212, the right read light relay 214, the left room light relay 216, the left rear light relay 218, the switch transformer 222, the right head light transformer 228 and the left read light transformer 226. Box 80 will contain, additionally, the necessary starting units for the four fluorescent tubes.

Low intensity room lights 166 are low voltage switched as will be apparent from an examination of FIGS. 12*a* and 12*b*. Reading lights 196 are similarly low-voltage switched. This permits the switching circuits for these particular lights to be run into the communications box 130 and transferred therefrom by pendant control, pillow speaker or the service extension option to be discussed hereinafter to within easy reach of the patient. The high intensity general room illumination light is high voltage switched in the embodiment shown and switchable only from the switches 200 on the front of the unit. All wiring shown in FIGS. 12*a* and 12*b* is preferably completed at the factory as opposed to the installation sites.

Figure 14:
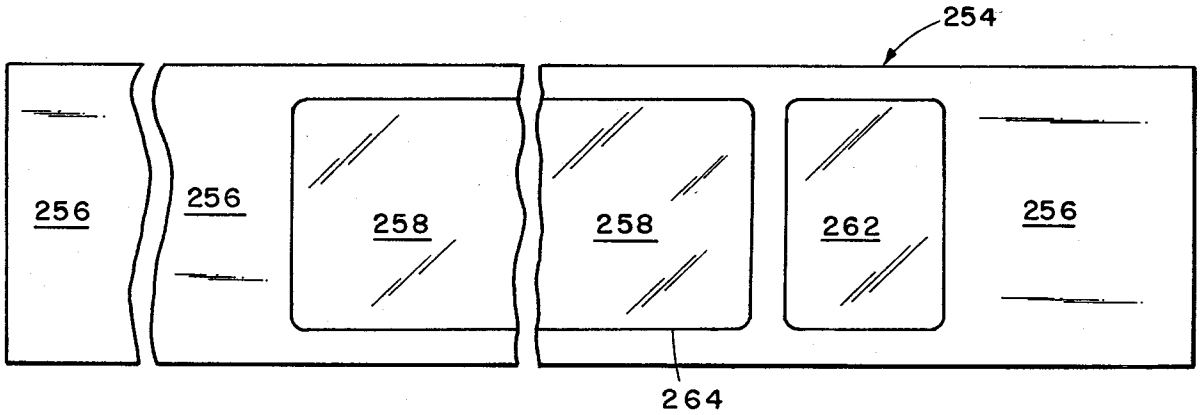
FIG. 14 is a plan view of the interior surface of the door lens.

The unit 10, once factory assembly has been completed, is decoratively enclosed. The lens door 250, with additional reference to FIG. 14, includes an aluminum extrusion enveloping a lens 254 which, preferably, comprises a sheet of virgin acrylic. The sheet 254 is painted an opaque off-white where indicated by the reference numeral 256, frosted at area 258 which overlies the general room illumination compartment 68 and left clear at 262, the area overlying reading light housing 66. A series of white opaque strips 264, again on the interior side of lens 254, are included to soften the exterior visual transition from the opaque off-white areas to the frosted and clear areas. The lens 254 may be easily coated, in the pattern desired, by means of conventional silkscreening processes. The area of the lens overlying unused compartment 72, of course, would be modified were any lighting components such as an observation light to be placed therein.

The outlet and night light cover 270 shown in FIG. 4 can be formed from sheet metal or plastic. It includes outlet apertures 272 basically identical to those found in a conventional outlet cover and can be held in position in the same manner. It also includes, to either side of the outlets 272, a louvered section 274 through which the light from night light assemblies 150 is emitted to the floor area between the beds.

The nurse call cover panel 280 is formed from a sheet of particle board 282 having a suitable covering such as wood-grained plastic. It is enveloped by an aluminum extrusion 284 and contains the aperture through or into which the nurse call system chassis is positioned, the nurse call front plate with the controls and pillow speaker or pendant control sockets thereon forming a decorative finished appearance. Cover 280 also includes switch apertures 288 to receive the boxes from switches 200 which, similarly, are decoratively covered at the exterior of the unit by switch plates 288*a*.

The gas cover panel 296 is also formed from a rectangular piece of particle board 297 having a decorative coating which conveniently may match that of the nurse call cover panel 280 and the electrical box cover panel 290 to be described hereinafter. Panel 297 is also enveloped by a decorative aluminum extrusion 298 and contains apertures 299 as necessary to permit installation of and access to the gas outlets 144.

The visible boundaries of the central section are completed by the electrical box cover panel 290 which includes a suitably covered or decorated sheet of particle board 292 having an aluminum extrusion therearound. Panels 280 and 296 are conveniently attached to the face of the unit by means of bolts passing through the side extrusion members and section 58 of front reflector 48. The screws or bolts can be secured by conventional nuts which will be accessible when the lens door 259 is removed.

The electrical box cover 290 can be secured in the same manner but, preferably, is held in position by studs on its rear side which fit into and slide downwardly into suitable keyhole apertures on member 58. This mode of attachment is preferred since the electrical panel must always be removed during installation to permit connection of the electrical services to the unit.

The lens door 250 can be affixed to the sides of the unit by screws passing through acute flange 46 of rear reflector 38 and obtuse flange 59 of front reflector 48. Preferably, however, it will be designed to slide forwardly into and interlock with the extrusions on covers 280 and 290 such that screws are required only along the rear edge into member 46.

Each of the lighting sections 20 also includes a bumper assembly 300 which can be molded from relatively rigid but non-marring plastic. The bumper includes a frontal section 302 adapted to wrap around the unit and mate decoratively and protectively with cover 270. The bumper is notched at 304 for receipt of members 58 and 59, includes an angular section 306 and a wall abutting rounded section 308. Its underside is formed similarly to the upper side visible in FIG. 4 and it can be affixed to the unit by passing screws through holes 314 into suitable pilot apertures in member 34 bounding the bottom of compartment 72, the flap containing holes 314 overlying the same. The bottom, similarly, may be screwed from the underside into bottom cap 32.

Bumper 300, when the unit is installed, prevents the bed from striking lens 254 and, to some extent, the headwall in general. The leg of the bed adjacent the unit, conveniently, can be nested into the corner 312 lying between rounded section 308 and angular section 306 to insure that the non-adjustable lights will project their rays in a proper direction with respect to the bed.

SERVICE EXTENSION OPTION

Figure 22:
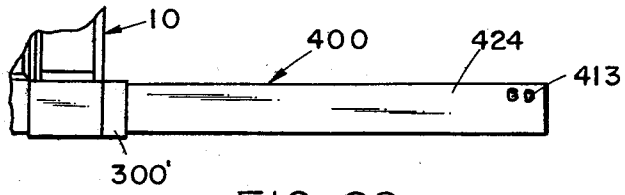
FIG. 22 is a fragmentary, front elevation of the system illustrating the service extension option included therewith.

In some localities it is required by code that an outlet be available at either side of the patient bed. It will often be desirable, additionally, to utilize a so-called electronic bedside cabinet on that side of the patient bed opposite from patient headwall unit 10 to contain the nurse call, switching functions and the like if such falls within the prescribed budget. In either or both of these cases the service extension option illustrated in FIGS. 22 and 23 can be utilized.

Service extension option 400 includes an adaptor 402 which is positioned in the place otherwise occupied by bumper 300. Extended from the channel-shaped rear extremity 404 of adaptor 402 is a raceway 406 which includes a central partition 408 dividing it into an upper channel 412 (high voltage) and a lower channel 416 (low voltage). Raceway 406 is sufficiently long, of course, that its unit-remote extremity will be readily accessible at the side of the bed. A suitable aperture 418 is provided in the base at the unit-remote extremity of lower channel 416 to accept the nurse call plug into which the electronic bedside cabinet is conventionally connected. An outlet 413 is positioned in upper channel 412 to provide the desired or necessary high voltage to the unit-remote side of the bed.

Once the raceway 406 has been affixed to the wall in the desired position and the electrical connections or assembly as hereinafter described made, a relatively rigid but non-marring cover 424 made of plastic or other suitable material is affixed thereto. Cover 424 contains outlet plate-like apertures 426 designed to overlie and make accessible the electrical outlet 413. It will also include an aperture in its lower sidewall mating with aperture 418 to permit protrusion of the nurse call plug. Cover 424 functions to prevent the bed from bumping the headwall as well as to close off raceway 406.

Figure 23:
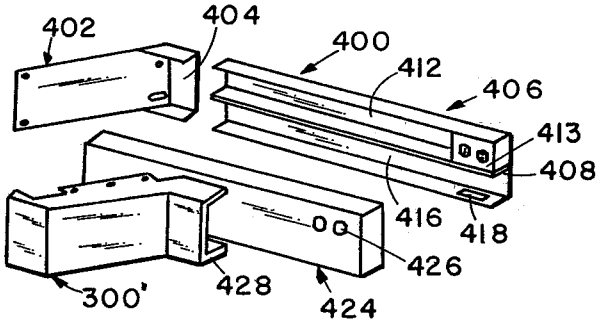
FIG. 23 is an exploded, perspective view of the service extension option.

The service extension 400 is completed by installation of the modified bumper 300' illustrated in FIG. 23. Bumper 300' can, if desirable, be made directly from the molded bumper 300 by cutting the end thereof off as indicated at 428 such that the same will overlie and form a smooth continuation of cover 424. The bumper 300' is affixed to unit 10 in the same manner as described with respect to bumper 300.

If the unit is utilized with an electronic bedside cabinet, the nurse call unit will ordinarily not be installed within box 130. Two separate nurse call units will be positioned, rather, within the cabinets at the outboard side of either bed. These units, as is the case where pendant controls are run from the headwall unit, will contain necessary switching and other controls for lighting, entertainment and the like.

INSTALLATION

Figure 15:
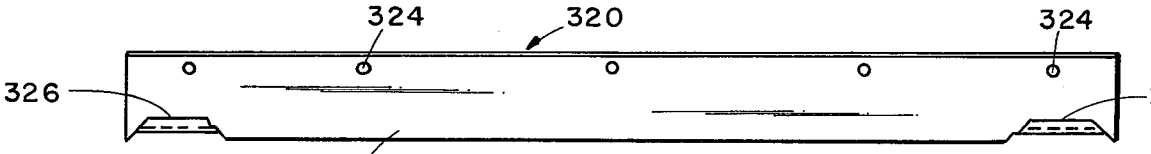
FIGS. 15 and 16 are front and side elevation views, respectively, of the hanger bracket which is adapted to support the system on the wall.
Figure 16:
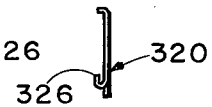

FIGS. 15 and 16 illustrate the hanger bracket 320 which is utilized to suspend unit 10 on the headwall 330 during installation. The unit, as noted previously, will typically arrive at the job site in the rigid configuration illustrated in FIG. 1 absent, of course, the shroud 340 and, possibly, the nurse call unit and gas outlets.

Figure 2:
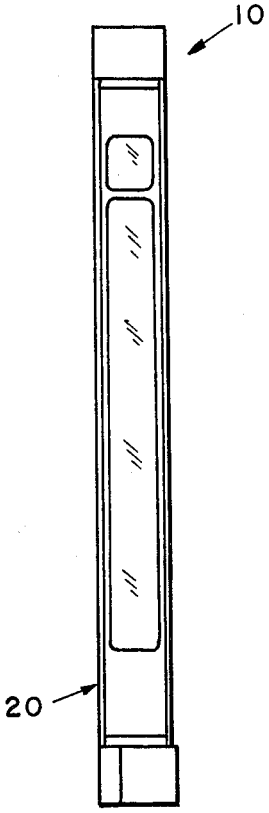
FIG. 2 is a side elevation thereof.
Figure 1:
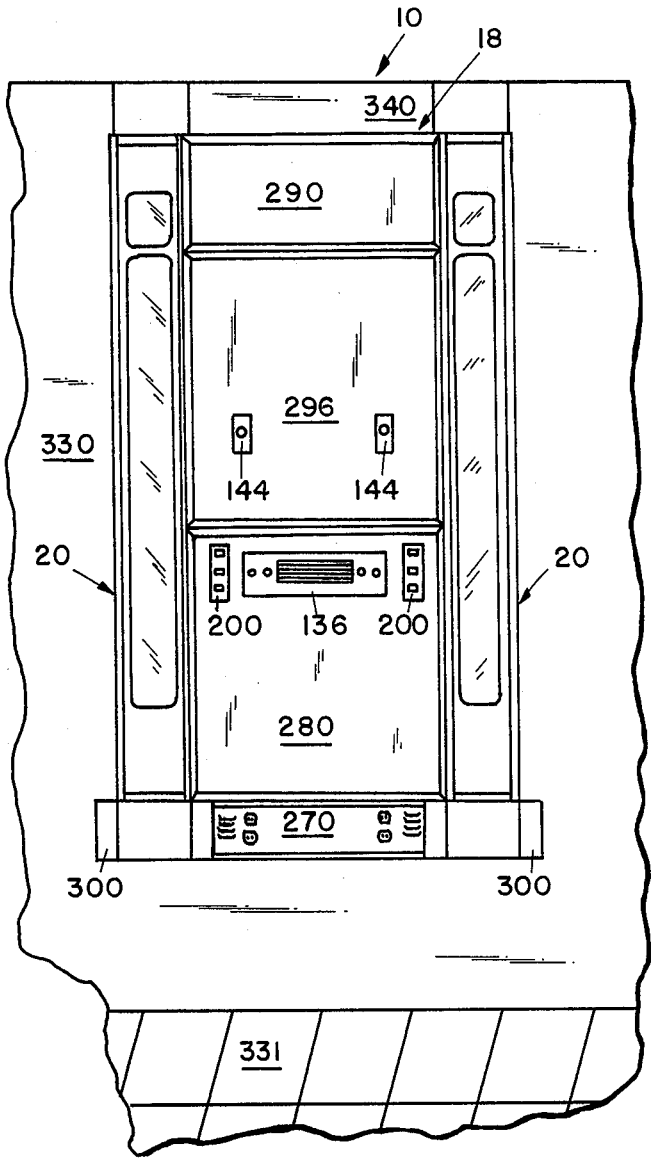
FIG. 1 is a front elevation view of the patient headwall system which is the subject of this invention.
Figure 17:
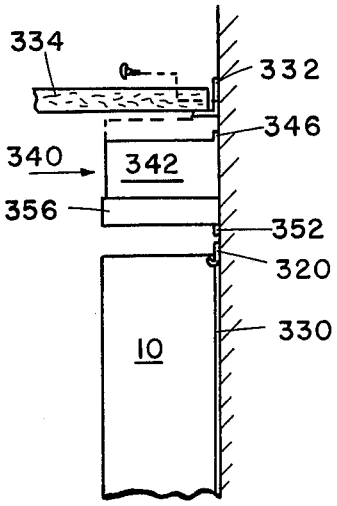
FIG. 17 is a schematic, side elevation illustrating the manner in which the system is installed on the patient headwall.

Hanger bracket 320, which includes an elongated rectangular bar section 322 having apertures 324 therein and formed hooks 326 is secured to the headwall 330 at the proper location. This is done by running, depending upon wall construction, toggle bolts or the like through the various apertures 324. The unit 10 is then hung on the hooks 326 by engaging the same into the hook-receiving apertures 28 (FIG. 4) in the top cap 22 of each of the light sections 20. The weight of the unit, at this point, is borne by the upturned flange 26 on top cap 22 in conjunction with the rear reflector 38. Once hanging is completed, the unit 10 is stabilized from outward swinging or vertical movement by running a lag screw or similar fastening device through the downturned flanges on bottom cap 32 or through the rear reflector into the wall. The unit 10 is shown suitably suspended to the wall 330 in FIG. 17. The bottom of the unit is, of course, off the floor a distance of 12–18 inches as illustrated in FIG. 1 to facilitate cleaning and the like.

Once the unit 10 has been securely suspended from the wall, the various services are dropped through the ceiling directly thereabove in accordance with the preferred embodiment of this invention. The line voltage cable, typically enclosed in flexible conduit, will be run to a suitable knockout in electrical box 80 and secured thereto in conventional fashion. The hot side of the line is connected at terminal 19 on terminal board 1 and the neutral side to terminal 14 on terminal board 1. The ground is connected to ground lug 240. Once these line voltage connections are made, the cover 98 is secured to electrical box 80 as described earlier.

Gas installation is accomplished by running conventional tubing 148 connected to gas outlets 144 upwardly through the unit behind the electrical box 80. Suitable sweat joints or the like are then made to the appropriate supply lines in the ceiling area.

If the communication unit is to be installed at the hospital rather than at the factory, such installation is also made at this point. The low-voltage cable for this unit is also run upwardly through the unit behind electrical box 80 and suitably interconnected with the various low voltage conductors forming a part of the system in the ceiling.

If the nurse call unit has been factory installed, the low voltage cable issuing therefrom will have been routed to a suitable terminal strip in the left-hand compartment of box 130 and field connections are made there. If, alternatively, an electronic bedside cabinet is to be utilized in conjunction with the service extension illustrated in FIGS. 22 and 23, the cable is run from the terminal strip in box 130 to compartment 74 through suitable knockouts and along the lower raceway 416 illustrated in FIG. 23. A suitable nurse call plug is utilized in aperture 418 to permit interconnection of the electronic bedside cabinet to the system. Line voltage is run to outlet 413 through service extension 400 in a similar manner utilizing the upper raceway 412, the line voltage exiting the unit through suitable conduit 422. The cables, as noted previously, may be cut to length at the factory, terminated if desired, and stored in compartment 24 during transit of the unit to the installation site.

The nurse call manufacturer, typically, will provide two or more switches on the pendant control, pillow speaker or electronic bedside cabinet to be utilized for switching the lights by the patient. Such switches, as will be readily appreciated by those skilled in the art, are of the low voltage variety. In the preferred embodiment, one of the switches is utilized to control the low intensity general room illumination bulb 166 and the other to control the reading light 196. The switches on a given pendant control or electronic bedside cabinet associated with either side of the unit 10, of course, control the lights in that side of the unit. Provision for this low voltage switching can be made by running appropriate low voltage wires from the electrical box 80 to the nurse call box 130 during manufacture of the unit 10 at the factory.

The switches 200 are intended primarily for utilization by nursing personnel and the like. The low intensity room illumination light and the reading light will be switched by the patient through the pendant control plugged into the face of the nurse call unit 130 in the embodiment shown or from the electronic bedside cabinet. The patient, in the embodiment illustrated, will not be able to control the high intensity room illumination light except by manually contacting the appropriate switch on box 200. This particular mode of lighting control is the product, primarily, of a desire to make the unit as economical as possible, it being understood that the high intensity room illumination light could be low voltage switched if desired.

FIGS. 17 and 18–20 show the details of the expandable shroud 340 and its mode of installation. This shroud is utilized to conceal the service drops from the ceiling to the unit and to provide an overall finished appearance once installed.

Shroud 340 includes an upper member 342 having a frontal portion 344, diverging side portions 346, flanged lip 348 and inturned lip 352 having upstanding hanging tabs 354 projecting thereabove. The lower member 356 includes a frontal portion 358, diverging side portions 362, flanged lip 364 and inturned lip 366 having tabs 368 depending therefrom.

Upper and lower members 342 and 356 are sized such that upper member 342 is slidable in telescopic fashion into member 356, the two being expanded on installation the distance sufficient to accommodate varying ceiling heights. Shroud 340 is shaped such as to form a smooth upward continuation of the service unit 10 once installed and may, if desirable, be painted to match the walls of the patient room either before or subsequent to installation for a pleasing visual effect.

Once the required service drops have been completed, the involved ceiling tile 334 is apertured to permit passage of the services therethrough within the horizontal area bounded by the shroud 340. Tabs 346 on upper member 342 are fastened behind the conventional L-shaped peripheral ceiling support 332 by means of a screw or the like with the inturned flange positioned in general abutment with the ceiling. Lower shroud member 356 is secured by means of tabs 352 behind the unit 10 through suitable apertures in rear reflector 38 and/or top cap 22. The apertured ceiling tiling is then replaced completing the installation.

The finished installation provides a patient headwall unit fully capable of making quality patient services, and particularly lighting, available to the patient in either bed placed alongside thereof. The patient, through use of a pendant control or where utilized, an electronic bedside cabinet, can control for himself the reading and low intensity general room illumination lights. The reading light, which preferably utilizes a 12-volt, 50-watt sealed beam bulb, projects a sufficiently broad, intense and properly directed pattern of light to permit the patient to read comfortably, without eyestrain, regardless of the position of the headrest of the bed within which he is located.

The single, integral unit, capable of serving two beds, can be fabricated and sold relatively inexpensively. Its prewired and preassembled nature lends it to simple and expedient installation at the job site. It may be used, of course, either in new construction or remodeling.

While a preferred embodiment of the invention along with a single option has been illustrated in detail, it will be readily apparent to those skilled in the art that numerous other embodiments may be designed and fabricated without departing from the spirit and scope of this invention. Such other embodiments are to be deemed as specifically included within the scope of the hereinafter appended claims unless these claims, by their language, expressly state otherwise.

The embodiments of the invention in which an exclusive property or privilege is claimed are defined as follows.

1. A patient headwall unit adapted for positioning against the headwall of a patient room in a hospital or like facility between two beds, such unit comprising:

a generally rectangular, vertically elongated central section having means therein for accommodating electrical services and means for making such services available at the exterior of the unit for use at either of said beds;

a vertically elongated lighting section integral with and affixed to either side of said central section, each said lighting section being of heighth generally equal to said central section, each said lighting section including a reading light, a general room illumination light and means for directing the light rays from said reading light downwardly, outwardly and forwardly onto the upper section of the bed positioned adjacent thereto; and means for switching said reading and general room illumination lights on and off.

2. The unit as set forth in claim 1 which further comprises a bumper at the base of each said lighting section, said bumper being positioned so as to engage the leg of the bed positioned adjacent thereto to prevent the bed from striking and damaging the remaining portions of said lighting sections.

3. The unit as set forth in claim 1 wherein said central section includes at least two separate enclosed electrical boxes, one of said boxes being located toward the bottom of said central section and having electrical outlets positioned therein so as to be accessible at the front of said central section, the other of said boxes being located toward the top of said central section and having means therein for receiving electrical service supply lines from the building in which said patient room is located.

4. The unit as set forth in claim 1 wherein each of said lighting sections is vertically compartmentalized by generally horizontal dividers, the upper of said compartments containing said reading light, a lower of said compartments containing said general room illumination light.

5. The unit as set forth in claim 1 wherein the outward surfaces of said lighting sections diverge away from said central section toward said headwall and include lenses for said reading and general room illumination lights.

6. The unit as set forth in claim 1 further including means for providing at least two levels of general room illumination light.

7. The unit as set forth in claim 3 wherein said electrical boxes substantially span the distance between said lighting sections, the ends of said boxes being connected to said lighting sections to rigidify said central and lighting sections as a single unit.

8. The unit as set forth in claim 7 wherein at least the upper of said electrical boxes has a depth which is less than the depth of said lighting sections and is affixed to said lighting sections such that a space exists between it and the headwall when said unit is suspended thereon, whereby other services such as communication and/or gas can be routed downwardly into said unit through said space.

9. The unit as set forth in claim 1 wherein said central section further comprises at least two gas outlets on the front surface thereof.

10. The unit as set forth in claim 1 wherein said central section further comprises a nurse call unit on the front surface thereof.

11. The unit as set forth in claim 10 wherein said central section further comprises a third box suspended between said lighting sections, said third box receiving said nurse call unit.

12. The unit as set forth in claim 3 which further includes at least two fascia panels affixed to the front of said central section, the upper of said panels being removable to provide access to the uppermost electrical box for connection of incoming electrical service lines during installation of said unit.

13. The unit as set forth in claim 1 wherein said reading light comprises a low-voltage, sealed beam element positioned near the top of and within each of said lighting sections.

14. The unit as set forth in claim 13 which further includes a reading light mounting and reflecting member, said member being formed to include a surface positioned perpendicularly to a line directed downwardly, outwardly and forwardly from the lighting section toward the upper section of the bed positioned thereby, said reflecting surface having an aperture therein to receive said sealed beam element.

15. The unit as set forth in claim 14 wherein the diameter of said aperture is smaller than the diameter of said sealed beam element and wherein said element is secured to said mounting and reflecting member at the side thereof opposite from said surface and overlying said aperture.

16. The unit as set forth in claim 1 wherein said general room illumination light comprises a pair of separately switched fluorescent tubes positioned vertically in each of said lighting sections.

17. The unit as set forth in claim 16 wherein at least one of said tubes in each of said lighting sections and said reading light are low-voltage switched permitting remote switching thereof.

18. The unit as set forth in claim 1 further comprising a lens overlying the outward side of each of said lighting sections, said lens being formed from an elongated sheet of transparent material, said lens being coated with opaque material except adjacent said general room illumination, reading lights and any other lights contained in each of said lighting sections.

19. The unit as set forth in claim 1 which further comprises a shroud positionable between the top of at least said central section and the ceiling of said patient room to conceal service drops from the ceiling into said unit.

20. The unit as set forth in claim 19 wherein said shroud includes at least two telescopic sections adapted to expand to accommodate varying ceiling heights, said shroud covering the tops of both of said lighting sections and said central section and having a horizontal, cross-sectional configuration equivalent to that of said central and lighting sections.

21. The unit as set forth in claim 2 which further comprises a service extension to provide services to the side of one of said beds opposite said central and lighting sections along said headwall, said extension including a raceway adapted to be affixed to said headwall in such a fashion as to form a general continuation of said bumper, an outlet at the bumper remote extremity of said raceway, and a plastic cover overlying said raceway and said outlet.

22. The unit as set forth in claim 21 which further comprises a third compartment in the base of each of said lighting sections adjacent said bumper within which the service lines for said service extension can be stored during shipment to the installation situs.

23. The unit as set forth in claim 21 wherein said raceway contains at least two separate channels and which further comprises a low-voltage connection at the bumper remote extremity of said raceway for interconnection with an electronic bedside cabinet or the like.

24. The unit as set forth in claim 2 wherein the outward surfaces of said lighting sections diverge away from said central section toward said headwall and include lenses for said general room illumination lights.

25. The unit as set forth in claim 24 wherein said reading light is positioned near the top of and within each of said lighting sections.

26. The unit as set forth in claim 25 which further includes a reading light reflecting member, said member being formed to include a surface positioned perpendicularly to a line directed downwardly, outwardly and forwardly from the lighting section toward the upper section of the bed positioned thereby.

27. The unit as set forth in claim 26 wherein said reading light comprises a low-voltage, sealed beam element.

28. The unit as set forth in claim 25 wherein said general room illumination light comprises at least one elongated fluorescent tube vertically positioned within each of said lighting sections below the reading light.

29. The unit as set forth in claim 28 wherein said general room illumination light comprises a pair of separately switched fluorescent tubes positioned vertically in each of said lighting sections in side by side relationship.

30. The unit as set forth in claim 29 wherein at least one of said tubes in each of said lighting sections and said reading light are low-voltage switched permitting remote switching thereof.

31. The unit as set forth in claim 28 further comprising a lens overlying the outward side of each of said lighting sections, said lens being formed from an elongated sheet of transparent material, said lens being coated with opaque material except adjacent said general room illumination, reading lights and any other lights contained in each of said lighting sections.

32. The unit as set forth in claim 25 wherein said bumper includes a rearwardly extending angular section and wall abutting section to form a nesting corner for the leg of the bed positioned thereagainst.

33. The unit as set forth in claim 28 wherein each of said lighting sections is formed from elongated, shaped sheet metal, a series of vertically spaced end caps and dividers being secured thereto to form a rigid structure.

34. The unit as set forth in claim 33 which further includes at least two spaced electrical boxes spanning the distance between and secured to said lighting sections to form said unit as an integral, rigid structure.

35. The unit as set forth in claim 34 wherein at least the upper of said electrical boxes has a depth which is less than the depth of said lighting sections and is affixed to said lighting sections such that a space exists between it and the headwall when said unit is suspended thereon, whereby other services such as communication and/or gas can be routed downwardly into said unit through said space.

36. The unit as set forth in claim 31 wherein said reading light comprises a low-voltage, sealed beam element.

37. The unit as set forth in claim 25 which further comprises an electrical box near the top thereof, said reading and general room illumination lights being prewired during fabrication of the unit, connections being provided within said electrical box to connect the incoming electrical service lines to the unit.

38. The unit as set forth in claim 25 wherein each of said lighting sections includes an elongated accessory mounting channel adjacent said central section.

39. The unit as set forth in claim 1 which further comprises means for hanging said unit on the headwall with the bottom thereof spaced from the floor.

40. The unit as set forth in claim 39 wherein said hanging means comprises an elongated member adapted to be affixed to the headwall, said member having at least two spaced hooks extending forwardly therefrom when so affixed; and means at the rear of each of said lighting sections for receiving said hooks.

41. A patient headwall unit adapted for suspension on the headwall of a patient room in a hospital or like facility adjacent a bed, said unit comprising:

a generally rectangular, vertically elongated central section having means therein for accommodating electrical services and for making such services available at the exterior of the unit for use at the bed;

a vertically elongated lighting section integral with and affixed to one side of said central section, said lighting section being of a heighth generally equal to said central section, the outer surface of said lighting section diverging away from said central section toward said headwall;

a reading light positioned within said lighting section near the top thereof and means for directing the light rays from said reading light downwardly, outwardly and forwardly onto the upper section of the bed positioned adjacent thereto;

a general room illumination light positioned within said lighting section; and means for switching said reading and general room illumination lights on and off.

* * * * *